US005411018A

United States Patent [19]

Rinehart

[11] Patent Number: 5,411,018

[45] Date of Patent: May 2, 1995

[54] UNDERWATER OXYGEN SUPPLY SYSTEM

[76] Inventor: Laney T. Rinehart, P.O. Box 4706, Panama City, Fla. 32401-1450

[21] Appl. No.: 249,468

[22] Filed: May 26, 1994

[51] Int. Cl.[6] ..... A62B 18/10

[52] U.S. Cl. ..... 128/201.28; 128/201.27; 128/204.26; 128/205.11

[58] Field of Search ..... 128/201.27, 201.28, 128/202.14, 204.26, 205.11, 205.24

[56] References Cited

U.S. PATENT DOCUMENTS

| | | | |
|---|---|---|---|
| 2,238,759 | 4/1941 | Vestrem | 128/201.27 |
| 3,693,653 | 9/1972 | Cramer et al. | 128/205.11 |
| 3,788,311 | 1/1974 | Fahlman et al. | 128/205.11 |
| 4,121,578 | 10/1978 | Torzala | 128/205.11 |
| 4,273,120 | 6/1981 | Oswell | 128/204.26 |
| 4,362,154 | 12/1982 | Le Masson | 128/201.27 |
| 4,449,524 | 5/1984 | Gray | 128/204.26 |
| 4,881,539 | 11/1989 | Pasternack | 128/201.27 |
| 4,951,660 | 8/1990 | Lubitzsch | 128/201.28 |
| 5,111,809 | 5/1992 | Gamble et al. | 128/205.11 |
| 5,127,398 | 7/1992 | Stone | 128/205.24 |

*Primary Examiner*—Edgar S. Burr
*Assistant Examiner*—Aaron J. Lewis
*Attorney, Agent, or Firm*—George A. Bode; Michael L. Hoelter

[57] ABSTRACT

An underwater breathing apparatus capable of supplying either 100% air, 100% oxygen, or an air/oxygen mixture to a diver as needed. A selector switch clearly indicates what is being supplied through the separate secondary breathing apparatus (or "octopus") of the rescuing diver. Also disclosed is a face mask to be placed around the nose and mouth of a diver in distress that is configured with an adaptor which accepts and seals around the mouthpiece of the secondary breathing apparatus. In this fashion, the rescuing diver can supply either air, oxygen, or a mixture of the two to a diver in distress in either a free-flow state or upon demand.

9 Claims, 4 Drawing Sheets

UNDERWATER OXYGEN SUPPLY SYSTEM

BACKGROUND OF THE INVENTION

1. Field of the Invention

This invention pertains to a self-contained underwater breathing apparatus (SCUBA) and more particularly to a device that is capable of supplying various oxygen-/air mixtures to a diver in distress whether the diver is below or above the surface of the water.

2. General Background

The sport of underwater diving is enjoyed by both amateurs and professionals alike. With the advent of diving computers, the duration and depth of each dive are more accurately assessed thereby permitting sufficiently longer "bottom time" than was previously available using standard Navy Dive Tables. Unfortunately, however, because of this increase in "bottom time", the diver is subject to a greater risk of incurring decompression sickness and/or air embolism. This risk increases should the diver also be overweight, out of shape, smoke, or have other health problems.

Decompression sickness, or the "bends", results from an increase of nitrogen gas bubbles in the blood stream as a consequence of breathing pressurized air. It is important for these pressurized gas bubbles to be removed from the blood stream before the diver surfaces. If they are not removed, their expansion in the diver's tissue upon surfacing can result in symptoms ranging from mild discomfort in the joints to complete incapacitation. If this occurs, it becomes extremely important for the diver to be re-pressurized, such as in a decompression tank or chamber, so that as much of the pressurized nitrogen can be removed as possible. Unfortunately, however, relocation of the diver to such a decompression tank or chamber is time consuming thereby causing the stricken diver much discomfort. Also, by the time such a tank is located, permanent physical damage to the diver may have already occurred. Furthermore, even though it is becoming more common for large dive boats to be outfitted with such decompression tanks, just by bringing the diver to the surface will increase the diver's pain, discomfort, and possibility of injury.

Air embolism is caused by the rupture of lung tissue due to the rapid expansion of pressurized air should the diver surface too quickly. It is vitally important for the diver to fully exhale during surfacing so as to remove all such pressurized air from the lungs before any damage can occur. Thus, divers must surface at a rate sufficient enough to remove as much pressurized air from the body's tissue as possible. Consequently, it has become normal operating procedure for divers to surface in stages, staying at one level for a certain period of time before moving on to the next level, so as to give the body time to rid itself of any lingering gas bubbles.

It has been found that supplying a diver suffering from the bends with 100% oxygen helps reduce and/or eliminate the pressurized nitrogen gas bubbles. Additionally, 100% oxygen has also been found useful in resuscitation techniques for both drowning victims as well as those with lung damage. In fact, SCUBA instructors and dive boats are now frequently coming equipped with an emergency oxygen tank for just this purpose.

In the event a diver in distress is brought to the surface, oxygen must be supplied as quickly as possible. Generally, the oxygen tanks on the dive ship are not immediately available and their connecting mouthpiece is either stored with the tank or elsewhere. Thus, precious time may be wasted assembling the necessary apparatus before oxygen can be made available to the diver in distress.

Despite all the precautions taken, divers still contact the bends and become disabled via air embolism. Also, just by bringing the distressed diver to the surface can result in sever injury even though the dive boat contains all the currently available safety features. It is thus an object of the present invention to provide a means of supplying emergency oxygen to a diver in distress either above or below the surface of the water as needed. A further object of the invention is the ability to supply either 100% oxygen, a mixture of air/oxygen, or 100% air to the diver in distress as may be required. Thus, by being able to supply 100% oxygen to a diver in distress before surfacing, the magnitude and consequence of contacting the bends and/or air embolism is significantly reduced. Still another object of the present invention is to provide a means of supplying emergency gas directly to a face mask placed over the diver in distress or fitted to an unconscious victim. Yet another object of the present invention is the ability to supply such gas mixture below the surface of the water without endangering the rescuing diver or requiring his/her mouthpiece removal. These and other objects and advantages of this invention will become obvious upon further investigation.

SUMMARY OF THE PRESENT INVENTION

The preferred embodiment of the apparatus of the present invention solves the aforementioned problems in a straightforward and simple manner. What is disclosed is an underwater breathing apparatus having a pressurized air tank, a primary breathing apparatus, and a separate secondary breathing apparatus with mouthpiece. The improvement consists of securing a separate pressurized oxygen tank to the air tank and connecting a first conduit to the air tank and a separate second conduit to the oxygen tank. A gas mixing valve couples to both of these conduits and is located intermediate the secondary breathing apparatus and these conduits. This gas mixing valve is configured with a selector switch for selectively supplying either pressurized air from the air tank, pressurized oxygen from the oxygen tank, or a pressurized air/oxygen mixture to the secondary breathing apparatus. Additionally the gas mixing valve contains an internal mixing chamber for combining the pressurized air and the pressurized oxygen therein prior to delivering this air/oxygen mixture to the secondary breathing apparatus. Check valves are also incorporated within this gas mixing valve to prevent any backflow through the gas mixing valve.

BRIEF DESCRIPTION OF THE DRAWING

For a further understanding of the nature and objects of the present invention, reference should be had to the following description taken in conjunction with the accompanying drawing in which like parts are given like reference numerals and, wherein.

DETAILED DESCRIPTION OF THE PREFERRED EMBODIMENT

Figure 1:
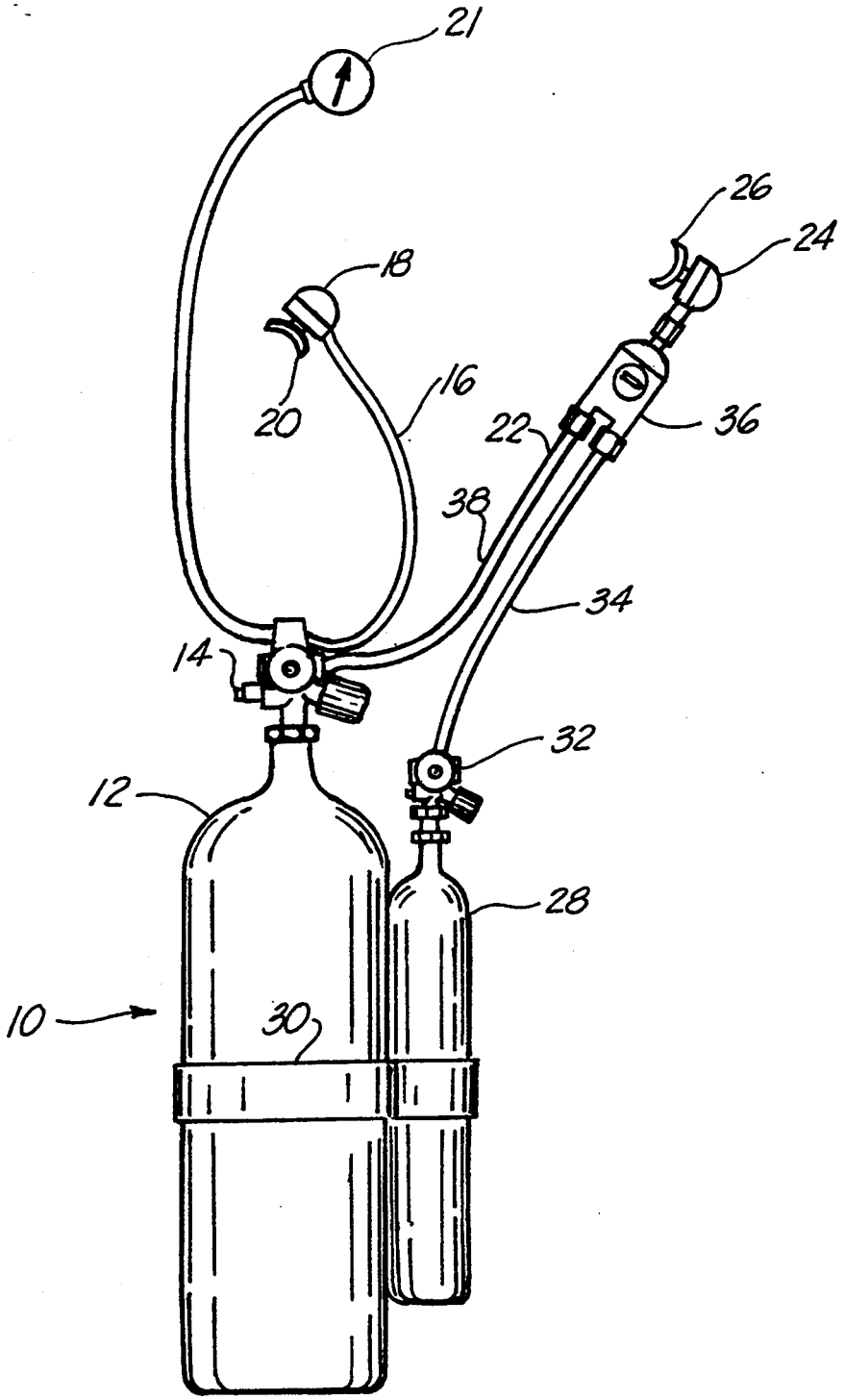
FIG. 1 is a pictorial view of an underwater breathing apparatus incorporating the invention.

Referring initially to FIG. 1, there is shown typical underwater breathing system 10. This system 10 incorporates a pressurized air tank 12 and a first stage regulator 14. Connected to first stage regulator 14 is primary breathing apparatus 16 having second stage regulator 18 and mouthpiece 20 designed to supply air to the diver upon demand. Second stage regulator 18 can also be adjusted to supply a free-flow of air to the diver if such is desired. A separate pressure gauge 21 is also connected to first stage regulator 14 which is used by the diver to monitor the amount of pressurized air remaining in tank 12. When the amount of air drops to a certain level, the diver must surface.

Also connected to first stage regulator 14 is a separate secondary breathing apparatus (or "octopus") 22 which incorporates second stage regulator 24 and mouthpiece 26. Second stage regulator 24 is generally free-flowing but it can also be adjusted to supply upon demand if desired.

The invention pertains to securing a separate smaller 100% oxygen tank 28 onto air tank 12 such as by strap 30 or the like. Other means of attachment are equally suitable with strap 30 being illustrated merely for descriptive ease. Oxygen tank 28 incorporates its own first stage regulator 32 secured to oxygen hose 34. Oxygen hose 34 delivers the stored oxygen to gas mixing valve 36 which is located intermediate first stage regulator 14 and second stage regulator 24 on octopus 22. Gas mixing valve 36 also receives air from tank 12 via air hose 38. Depending upon the setting of gas mixing valve 36, either 100% air from tank 12 is delivered to mouthpiece 26, or 100% oxygen from tank 28 is delivered to mouthpiece 26, or a mixture of the two (such as a 60/40 ratio of air/oxygen) is delivered to mouthpiece 26.

Figure 3:
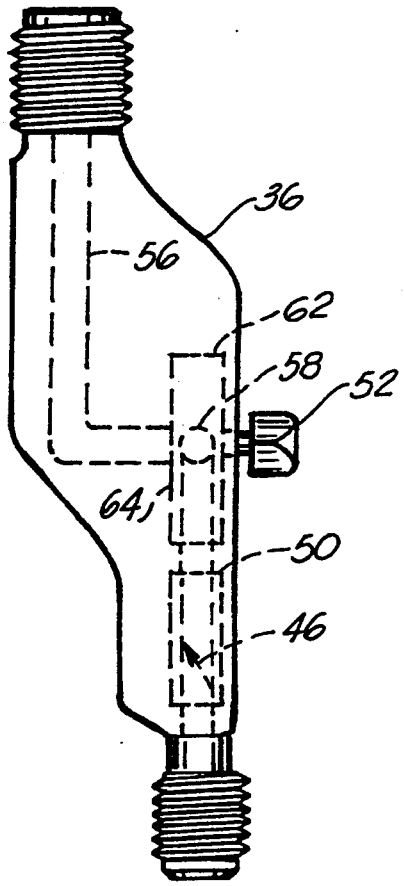
FIG. 3 is a side view, with the internal channels illustrated in dotted lines, of the gas mixing valve which forms a part of the invention.
Figure 2:
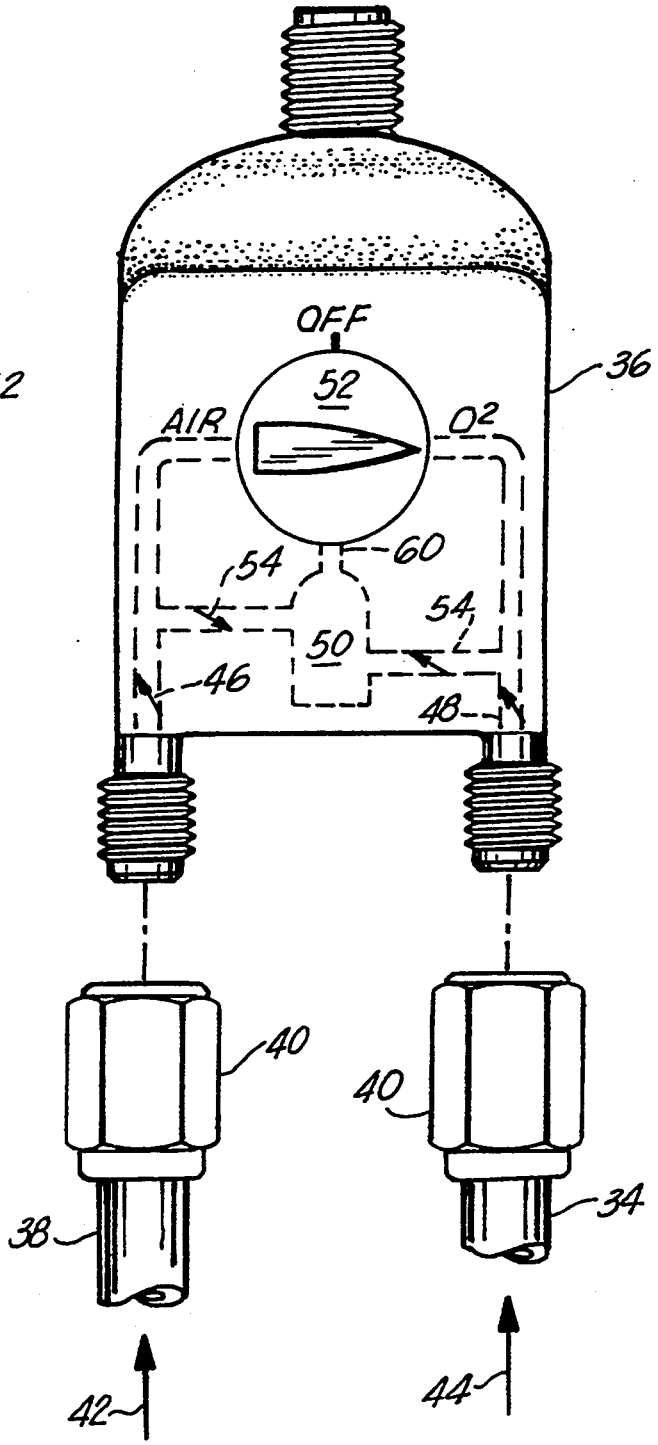
FIG. 2 is a front view, with the internal channels illustrated in dotted lines, of the gas mixing valve which forms a part of the invention.
Figure 4A:
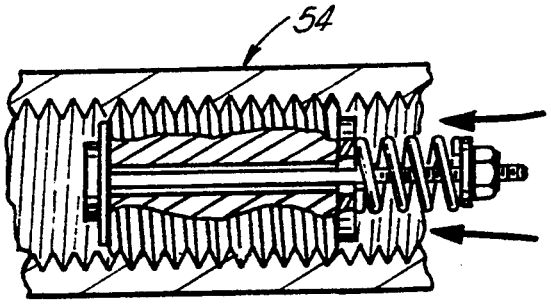
FIG. 4A is a sectional view of the preferred check valve which forms a part of the invention.

Referring now more specifically to FIGS. 2 and 3, gas mixing valve 36 is illustrated in greater detail. As shown, valve 36 is coupled to hoses 34 and 38 by standard threaded couplers 40. When thusly secured, each hose 34 and 38 delivers its product (either air 42 or oxygen 44) to its respective passageway 46 or 48 within gas mixing valve 36. Each passageway 46 and 48 is connected to both mixing chamber 50 and selector switch 52. Also, each passageway 46 and 48 contain typical check valves 54 therein to prevent any backflow within gas mixing valve 36.

Selector switch 52 determines whether air 42, oxygen 44, or a mixture of the two flows into exit passageway 56 thereby exiting gas mixing valve 36 and flowing to second stage regulator 24 and then to mouthpiece 26. In order to accomplish this task, selector switch 52 is configured with a central opening 58 therethrough which couples between exit passageway 58 and either air passageway 46, oxygen passageway 48, or mixing chamber passageway 60. As shown, central opening 58 is configured to couple with either passageway 46, 48, or 60 through its side 62 while also connecting with exit passageway 56 through its bottom 64. Selector switch 52 can also be adjusted so as not to connect with any such passageway 46, 48, or 60 thereby blocking any flow to exit passageway 56.

Depending upon the setting of selector switch 52, and as indicated above, either air passageway 46 is the only passageway open, or oxygen passageway 48 is the only passageway open, or mixing chamber passageway 60 is the only passageway open, or all three passageways 46, 48, and 60 are blocked. Selector switch 52 is clearly marked so as to indicate which setting is selected. In this fashion, when gas mixing valve is in use, both the diver in distress and the rescuing diver can readily determine which mixture is being supplied. Also, should circumstances warrant it, the mixture being supplied can easily be altered during use as needed.

Figure 4:
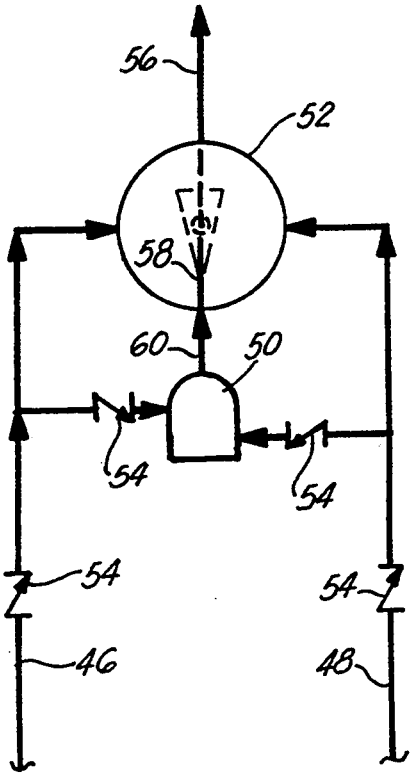
FIG. 4 is a schematic view of the operation of the gas mixing valve in the "mix" position.

FIG. 4 illustrates the setting wherein mixing chamber passageway 60 is open. At this setting, central opening 58 of selector switch 52 connects to mixing chamber passageway 60 thereby permitting a preset mixture (such as a 60%/40% mixture of air/oxygen) combined in mixing chamber 50 to flow to exit passageway 56. Also shown are check valves 54 just upstream mixing chamber 50 that prevent any back flow through passageways 46 or 48 which supply air 42 and oxygen 44 to mixing chamber 50. Generally, first stage regulators 14 and 32 supply their respective gas at relatively the same pressure so that no great pressure differential will exist between passageways 46 and 48.

Figure 6:
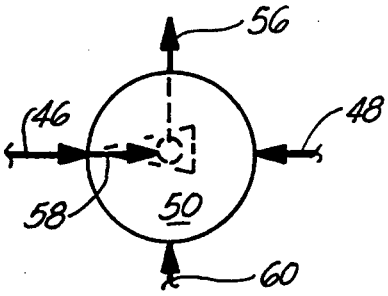
FIG. 6 is a schematic view, partially broken away, of the gas mixing valve in the "air" position.
Figure 7:
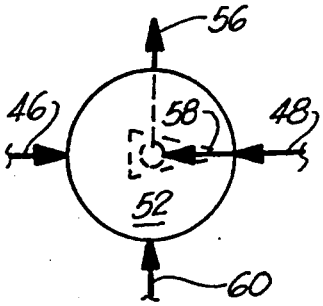
FIG. 7 is a schematic view, partially broken away, of the gas mixing valve in the "oxygen" position.
Figure 5:
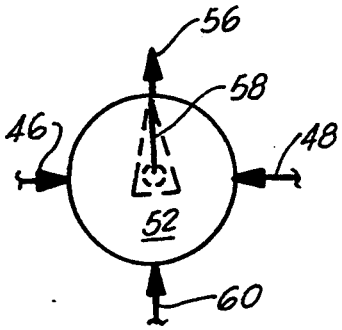
FIG. 5 is a schematic view, partially broken away, of the gas mixing valve in the "off" position.

FIG. 5 illustrates the setting wherein all three passageways 46, 48, and 60 are blocked thereby preventing any air or oxygen from flowing through exit passageway 56. FIG. 6 illustrates the setting wherein 100% air is supplied exit passageway 56 while FIG. 7 illustrates the setting wherein 100% oxygen is supplied exit passageway 56. Thus, whatever mixture is required for the situation at hand, the rescuing diver, or the diver in distress, can select the proper setting on selector switch 52 so as to supply this mixture to mouthpiece 26 on octopus 22.

Figure 8:
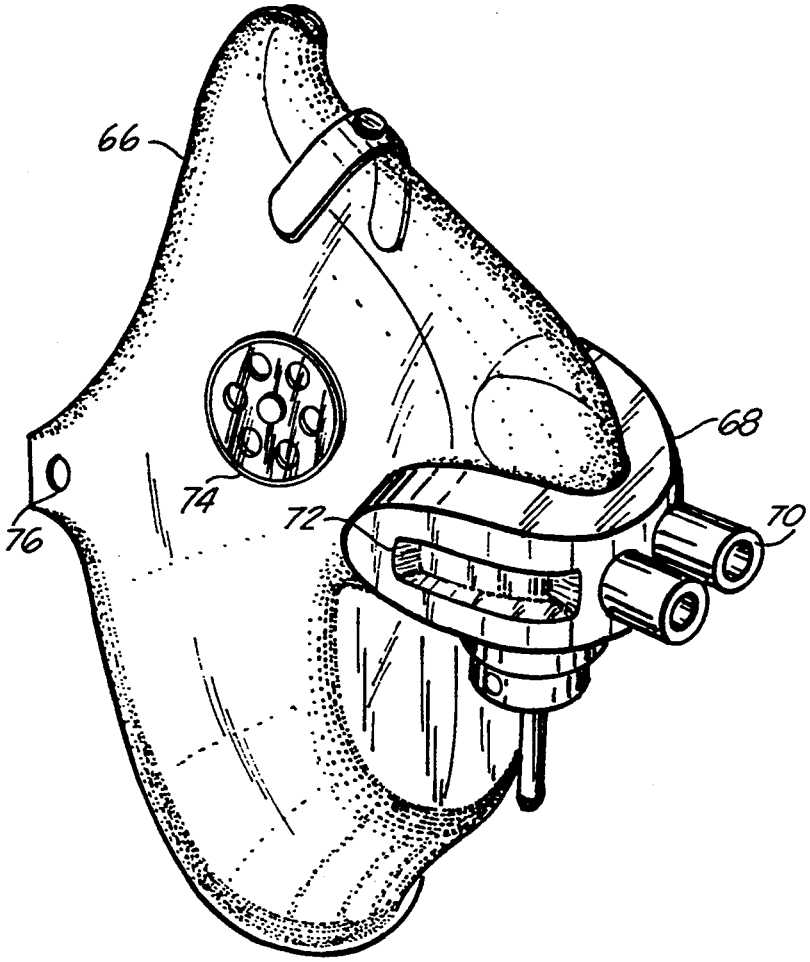
FIG. 8 is a pictorial view of the nasal mask accessory accompanying the invention; and, FIG. 9 is a top plan view of the mask of FIG. 8.
Figure 9:
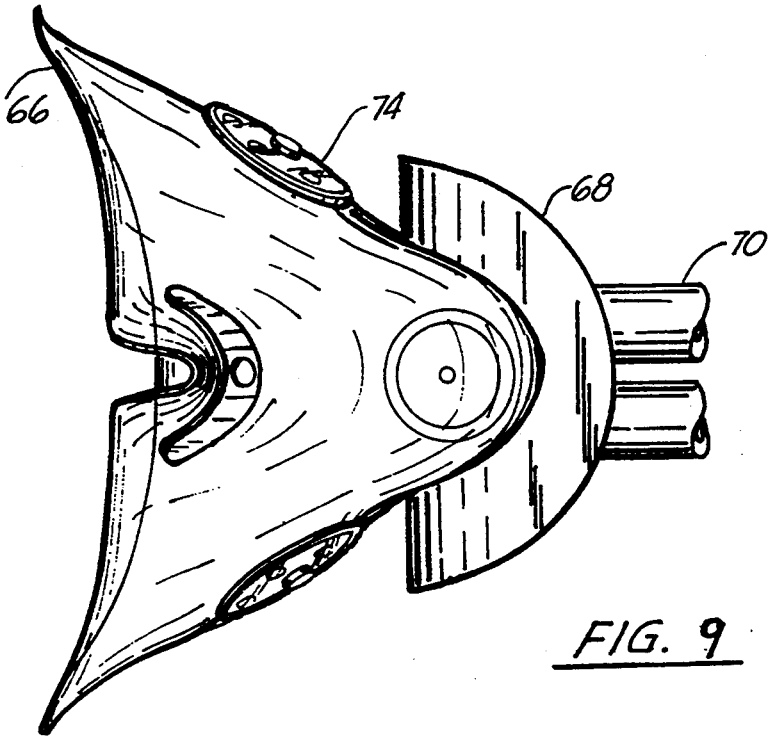

Referring now to FIG. 8, there is shown a typical oxygen mask 66 oftentimes used to supply oxygen to a diver in distress. Generally, mask 66 is used on the dive boat, but it can also be used in the water if need be. Mask 66 is modified to incorporate adaptor 68 which is configured to fit snugly within mouthpiece 26 of octopus 22. A pair of tubes 70 provide a channel for supplying the selected breathing medium from mouthpiece 26 to mask 66. Indentations 72 in both sides of adaptor 68 are sized to fit the normal teeth guards (not shown) found in most mouthpieces 26 thereby sealing between mouthpiece 26 and mask 66. Also, the projection of tubes 70 into mouthpiece 26 (when installed) further insure the delivery of the breathing medium to mask 66. Purge valves 74 on both sides of mask 66 permit the diver in distress to exhale as needed. Also, mask 66 may be secured around the diver's head by straps attached to openings 76 in mask 66 if desired.

Thus, during use, a diver in distress is fitted with mask 66 in the normal fashion with mask 66 already incorporating adaptor 68 (such as by being permanently secured thereto). Consequently, the rescuing diver need only insert mouthpiece 26 of his octopus 22 around adaptor 68 and select whether air 42, oxygen 44, or a mixture of the two is to be supplied. Also, second stage regulator 24 of octopus 22 can be adjusted to cause a free flow of this breathing medium to be forced into mask 66 until no longer needed. Alternatively, second stage regulator 24 can be adjusted to supply this breathing medium only upon demand if desired. In any event, the diver in distress is supplied the proper mixture in a timely fashion whether above the surface of the water (via mask 66) or below it (via mouthpiece 26).

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. An underwater breathing apparatus having a pressurized air tank, a primary breathing apparatus, and a separate secondary breathing apparatus with mouthpiece wherein the improvement comprises:

(a) a pressurized oxygen tank secured to the air tank;

(b) a first conduit coupled to the air tank and a separate second conduit coupled to said oxygen tank;

(c) a gas mixing valve coupled to both said conduits intermediate the secondary breathing apparatus and said conduits, said gas mixing valve comprising:

i. selector switch means for selectively supplying either pressurized air from the air tank, pressurized oxygen from said oxygen tank, or a pressurized air/oxygen mixture to the secondary breathing apparatus;

ii. an internal mixing chamber for combining said pressurized air and said pressurized oxygen therein prior to delivering said pressurized air/oxygen mixture to the secondary breathing apparatus; and, iii. check valve means for preventing backflow through said gas mixing valve.

2. The apparatus as set forth in claim 1 further comprising a face mask sealing around the nose and mouth of a user, said face mask comprising adaptor means for coupling with the mouthpiece of the secondary breathing apparatus.

3. The apparatus as set forth in claim 2, wherein said adaptor means further comprises projecting tube means for insertion into the mouthpiece when the mouthpiece and said adaptor means are coupled together.

4. The apparatus as set forth in claim 3, wherein said adaptor means further comprises indentations for accepting the mouthpiece therein and sealing between the mouthpiece and said adaptor means.

5. The apparatus as set forth in claim 4, wherein said face mask further comprises purge valve means for exhausting fluid from said face mask and attachment means for securing said face mask around the face of the user.

6. The apparatus as set forth in claim 5, wherein said internal mixing chamber supplies a 60%/40% air/oxygen mixture to the secondary breathing apparatus.

7. The apparatus as set forth in claim 6 further comprising a first stage regulator secured to the air tank, a separate first stage regulator secured to said oxygen tank, and a second stage regulator secured to the secondary breathing apparatus upstream the mouthpiece.

8. The apparatus as set forth in claim 7, wherein said second stage regulator upstream the mouthpiece can be adjusted to supply a free-flow of breathing medium to the user or said second stage regulator can be adjusted to supply said breathing medium upon demand.

9. The apparatus as set forth in claim 8, wherein said first stage regulator secured to the air tank also couples to the primary breathing apparatus and to a pressure gauge.

* * * * *